US010895179B2

(12) United States Patent
Kandolf

(10) Patent No.: US 10,895,179 B2
(45) Date of Patent: Jan. 19, 2021

(54) TRIGGER WHEEL ARRANGEMENT FOR CONCENTRICALLY ARRANGED CAMSHAFTS

(71) Applicant: Schaeffler Technologies AG & Co. KG, Herzogenaurach (DE)

(72) Inventor: Michael Kandolf, Saint Clair, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/244,156

(22) Filed: Jan. 10, 2019

(65) Prior Publication Data

US 2019/0218945 A1 Jul. 18, 2019

Related U.S. Application Data

(60) Provisional application No. 62/616,629, filed on Jan. 12, 2018.

(51) Int. Cl.
*F01L 1/344* (2006.01)
*F01L 1/047* (2006.01)

(52) U.S. Cl.
CPC ..... *F01L 1/3442* (2013.01); *F01L 2001/0473* (2013.01); *F01L 2001/34483* (2013.01); *F01L 2001/34493* (2013.01); *F01L 2820/041* (2013.01)

(58) Field of Classification Search
CPC ..... F01L 2001/0473; F01L 1/3442; F01L 2001/34493; F01L 1/047; F01L 2820/041; F01L 2001/34483
USPC ..... 123/90.17, 90.15, 90.31
See application file for complete search history.

(56) References Cited

U.S. PATENT DOCUMENTS

| | | | |
|---|---|---|---|
| 5,417,186 | A | 5/1995 | Elrod et al. |
| 7,789,054 | B2 | 9/2010 | Rozario et al. |
| 7,841,311 | B2 | 11/2010 | Hutcheson et al. |
| 8,051,818 | B2 | 11/2011 | Myers et al. |
| 8,186,319 | B2 | 5/2012 | Pluta et al. |

(Continued)

FOREIGN PATENT DOCUMENTS

| | | |
|---|---|---|
| DE | 19581459 T1 | 2/1997 |
| DE | 102009041873 A1 | 4/2010 |

(Continued)

*Primary Examiner* — Patrick Hamo
*Assistant Examiner* — Wesley G Harris

(57) ABSTRACT

A camshaft phaser assembly, including: an axis of rotation; a first hydraulic camshaft phaser including a first stator arranged to receive rotational torque, a first rotor including a plurality of first through-bores, and a first plurality of phaser chambers circumferentially bounded by the first stator and the first rotor; a second hydraulic camshaft phaser including a second stator non-rotatably connected to the first stator, a second rotor, and a second plurality of phaser chambers circumferentially bounded by the second stator and the second rotor; a first trigger wheel including a plurality of second through-bores connected to the plurality of first through-bores, non-rotatably connected to the first rotor, and arranged to identify a rotational position of the first rotor; and a second trigger wheel non-rotatably connected to the second rotor and arranged to identify a rotational position of the second rotor.

19 Claims, 10 Drawing Sheets

(56) References Cited

U.S. PATENT DOCUMENTS

| | | | | |
|---|---|---|---|---|
| 8,201,528 | B2 * | 6/2012 | Knecht | F01L 1/022 123/90.17 |
| 8,261,705 | B2 | 9/2012 | Lancefield et al. | |
| 8,375,906 | B2 | 2/2013 | Myers et al. | |
| 2004/0154566 | A1 * | 8/2004 | Naito | F01L 1/022 123/90.15 |
| 2005/0066924 | A1 * | 3/2005 | Lehmann | F01L 1/022 123/90.17 |
| 2007/0215079 | A1 * | 9/2007 | Boggess | F01L 1/053 123/90.15 |
| 2007/0261670 | A1 * | 11/2007 | Nguyen | F01L 1/3442 123/406.59 |
| 2009/0211549 | A1 * | 8/2009 | Myers | F01L 1/3442 123/90.17 |
| 2010/0093453 | A1 * | 4/2010 | Myers | F01L 1/3442 464/160 |
| 2015/0267570 | A1 * | 9/2015 | Bayrakdar | F01L 1/3442 123/90.17 |
| 2020/0095906 | A1 | 3/2020 | Mlinaric | |

FOREIGN PATENT DOCUMENTS

| | | | | |
|---|---|---|---|---|
| DE | 102015205770 | A1 * | 10/2016 | F01L 1/3442 |
| DE | 102014212615 | B4 * | 9/2017 | |

* cited by examiner

TRIGGER WHEEL ARRANGEMENT FOR CONCENTRICALLY ARRANGED CAMSHAFTS

CROSS-REFERENCE TO RELATED APPLICATIONS

This application claims the benefit under 35 U.S.C. § 119(e) of U.S. Provisional Patent Application No. 62/616,629, filed Jan. 12, 2018, which application is incorporated herein by reference in its entirety.

TECHNICAL FIELD

This disclosure is generally related to camshaft phasers, and, more particularly, to camshaft phasers utilized within an internal combustion engine having concentrically arranged camshafts.

BACKGROUND

For some known dual hydraulic camshaft phaser assemblies, providing a thrust surface to contact an engine block is required. For all known dual hydraulic camshaft phaser assemblies, it is required to provide oil to the camshaft phasers from the concentric camshaft. Known means of providing the oil including through one or more journal bearings of the concentric camshaft assembly.

SUMMARY

According to aspects illustrated herein, there is provided a camshaft phaser assembly, including: an axis of rotation; a first hydraulic camshaft phaser including a first stator arranged to receive rotational torque, a first rotor including a plurality of first through-bores, and a first plurality of phaser chambers circumferentially bounded by the first stator and the first rotor; a second hydraulic camshaft phaser including a second stator non-rotatably connected to the first stator, a second rotor, and a second plurality of phaser chambers circumferentially bounded by the second stator and the second rotor; a first trigger wheel including a plurality of second through-bores connected to the plurality of first through-bores, non-rotatably connected to the first rotor, and arranged to identify a rotational position of the first rotor; and a second trigger wheel non-rotatably connected to the second rotor and arranged to identify a rotational position of the second rotor.

According to aspects illustrated herein, there is provided a camshaft phaser assembly, including: an axis of rotation; a first hydraulic phaser; a second hydraulic phaser; a first trigger wheel; and a second trigger wheel. The first hydraulic camshaft phaser includes: a first stator arranged to receive rotational torque; a first rotor; and a first plurality of phaser chambers circumferentially bounded by the first stator and the first rotor; a plurality of first through-bores in the first rotor connected to the plurality of first phaser chambers included in the first plurality of phaser chambers; and a plurality of second through-bores in the first rotor connected to a plurality of second phaser chambers, the plurality of second phaser chambers included in the first plurality of phaser chambers and circumferentially interleaved with the plurality of first phaser chambers; The second hydraulic camshaft phaser includes: a second stator non-rotatably connected to the first stator; a second rotor; and a second plurality of phaser chambers circumferentially bounded by the second stator and the second rotor. The first trigger wheel: is non-rotatably connected to the first rotor; is arranged to identify a rotational position of the first rotor; and includes a plurality of third through-bores connected to the plurality of first through-bores and a plurality of fourth through-bores connected to the plurality of second through-bores. The second trigger wheel is non-rotatably connected to the second rotor and is arranged to identify a rotational position of the second rotor.

According to aspects illustrated herein, there is provided a method of using a camshaft phaser assembly, the camshaft phaser assembly including: a first hydraulic camshaft phaser with a stator, a rotor and a plurality of phaser chambers bounded by the stator and the rotor; a second hydraulic camshaft phaser; a first trigger wheel non-rotatably connected to the rotor; and a second trigger wheel connected to the second hydraulic camshaft phaser, the method comprising: non-rotatably connecting the rotor to a first camshaft of an internal combustion engine of a vehicle; starting the internal combustion engine; transmitting rotational torque from the internal combustion engine to the stator; rotating, with the rotational torque, the stator and the rotor; creating, with the rotation of the stator and the rotor, a thrust force; urging, with the thrust force, the first hydraulic camshaft phaser toward an engine block of the internal combustion engine; contacting the engine block with a surface of the first trigger wheel; identifying, using the first trigger wheel, a rotational position of the rotor; flowing oil to the plurality of phaser chambers through a first plurality of through-bores in the first trigger wheel connected to a second plurality of through-bores in the rotor and through a third plurality of through-bores in the first trigger wheel connected to a fourth plurality of through-bores in the rotor; and rotating the rotor with respect to the stator.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure FIG. 1 is a side view of camshaft phaser assembly 100 with dual hydraulic camshaft phasers.

Figure 1:
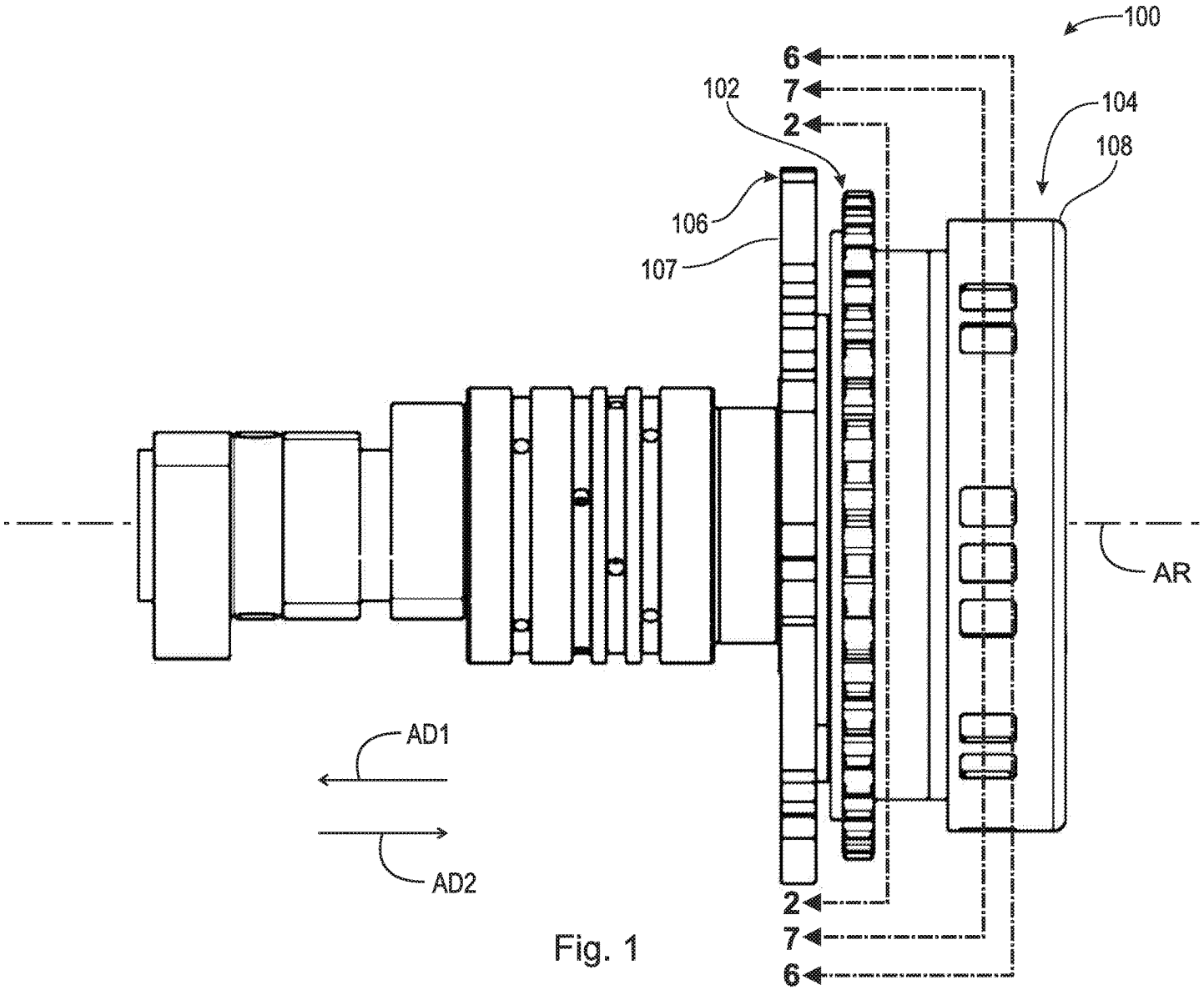
FIG. 1 is a side view of a camshaft phaser assembly with dual hydraulic camshaft phasers.
Figure 2:
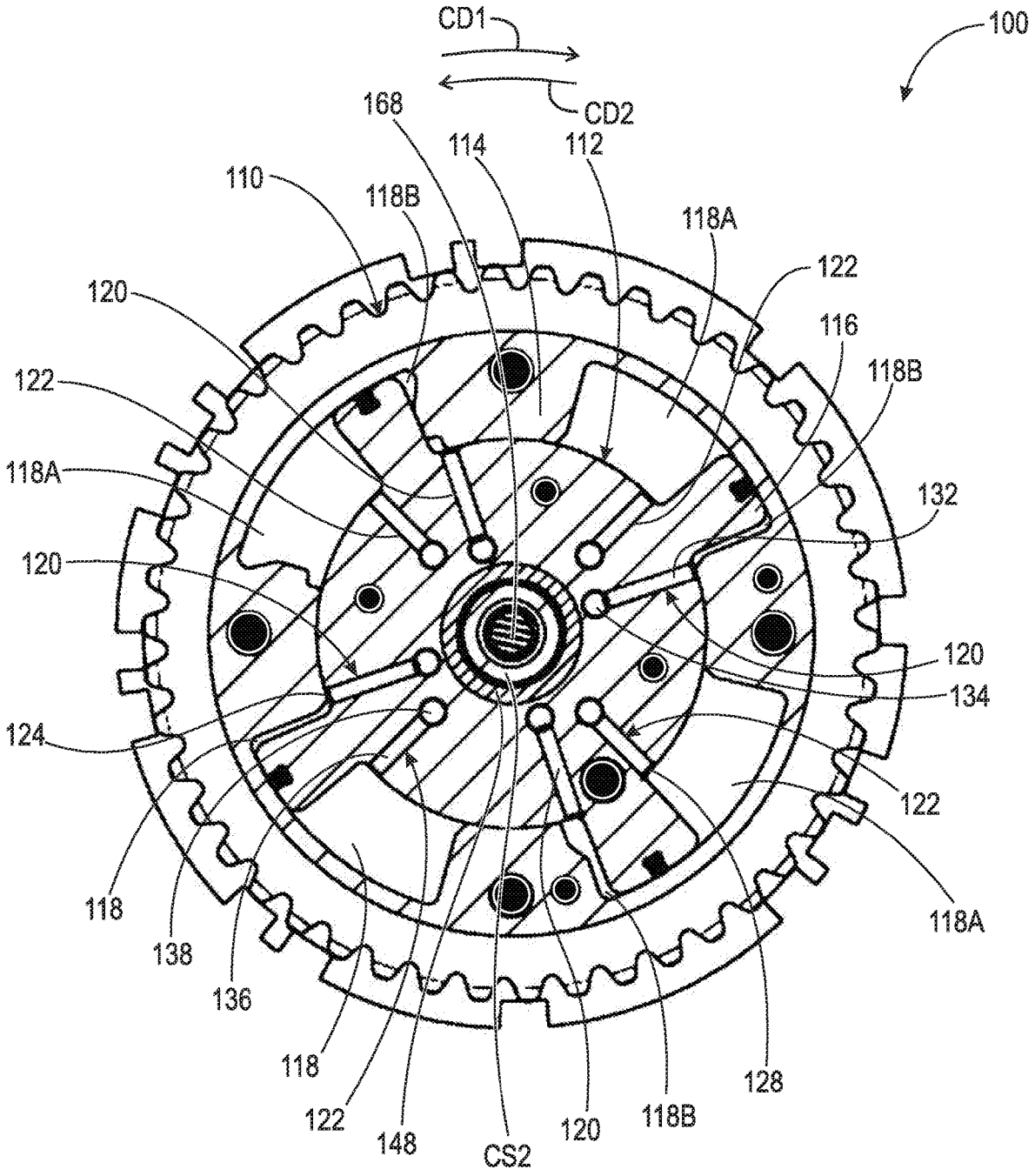
FIG. 2 is a cross-sectional view generally along line 2-2 in FIG. 1.

FIG. 2 is a cross-sectional view generally along line 2-2 in FIG. 1. The following should be viewed in light of FIGS. 1 and 2. Camshaft phaser assembly 100 includes: axis of rotation AR; hydraulic camshaft phaser 102; hydraulic camshaft phaser 104; trigger wheel 106 including surface 107 facing in axial direction AD1; and trigger wheel 108. Surface 107 forms an axial end of trigger wheel 106. Phasers 102 and 104 are axially bracketed by trigger wheels 106 and 108. Stated otherwise, phasers 102 and 104 are axially disposed between trigger wheels 106 and 108. Phaser 102 includes stator 110 and rotor 112. Stator 110 is arranged to receive rotational torque and includes radially inwardly extending protrusions 114. Rotor 112 includes radially outwardly extending protrusions 116 circumferentially interleaved with radially inwardly extending protrusions 114. By "circumferentially interleaved" components, we mean the components alternate in a circumferential direction. For example, protrusions 114 and 116 alternate in circumferential direction CD1. Phaser 102 includes phaser chambers 118 bounded by stator 110 and rotor 112.

Trigger wheel 106 is non-rotatably connected to rotor 112. As further described below, wheel 106 is arranged to identify a rotational position of rotor 112. By "non-rotatably connected" components, we mean that: the components are connected so that whenever one of the components rotates, all the components rotate; and relative rotation between the components is not possible. Radial and/or axial movement of non-rotatably connected components with respect to each other is possible, but not required.

In the example of FIG. 1, phaser chambers 118 include pairs of advance chambers 118A and retard chambers 118B, alternating in circumferential direction CD1 and whose function is discussed below. Stated otherwise, each chamber 118A is circumferentially adjacent to a chamber 118B. Each phaser chamber 118 is circumferentially bounded by a respective radially inwardly extending protrusion 114 and a respective radially outwardly extending protrusion 116. For example: each advance chamber 118A is bounded by a respective protrusion 116 in direction CD1 and by a respective protrusion 114 in direction CD2, opposite direction CD1; and, each retard chamber 118B is bounded by a respective protrusion 114 in direction CD1 and by a respective protrusion 116 in direction CD2, In general, a reference character "[digit] [digit] [digit] [letter]" designates a specific example of an element labeled as "[digit] [digit] [digit]." For example, advance phaser chambers 118A are specific examples from among phaser chambers 118.

Figure 3:
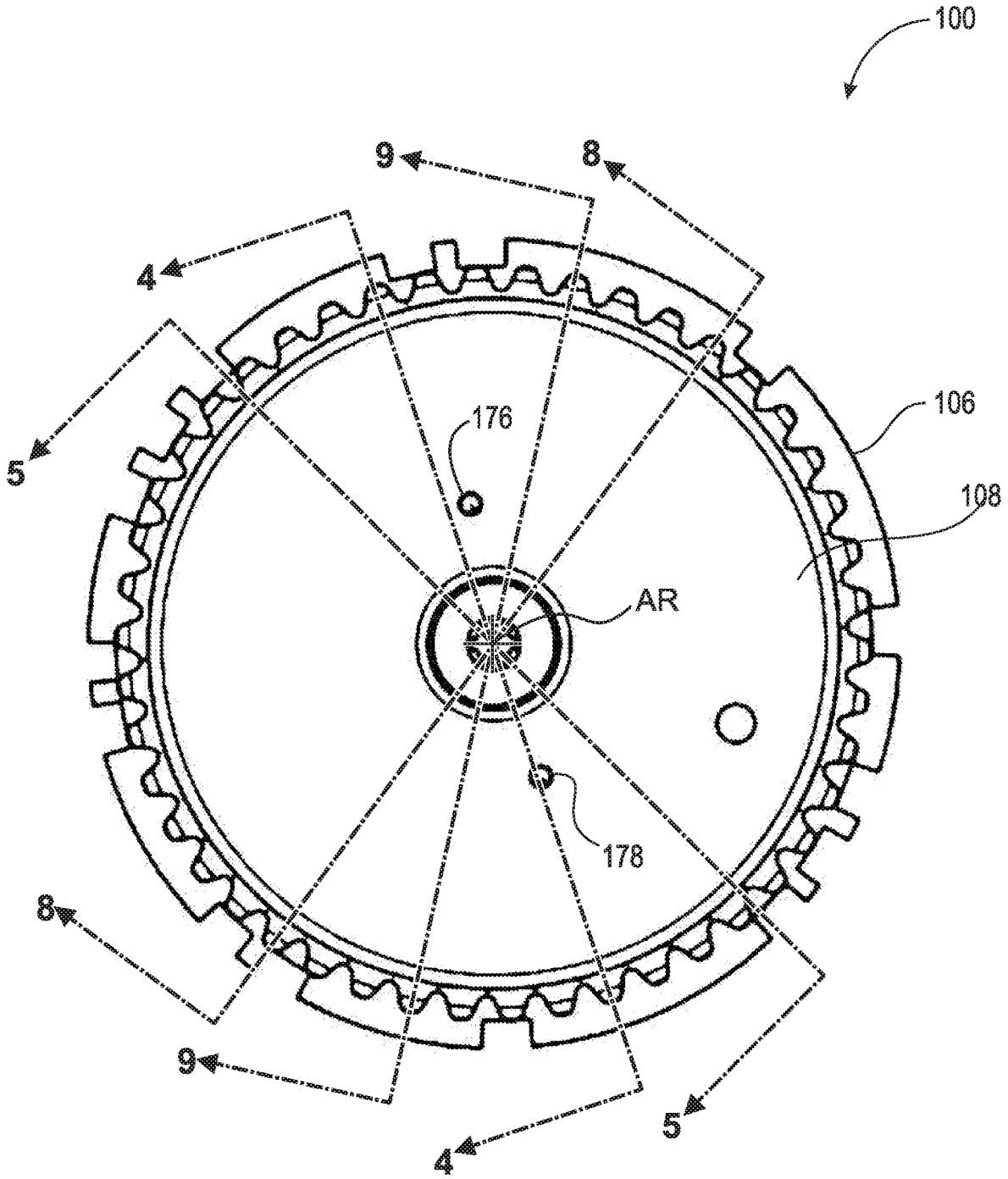
FIG. 3 is a front view of the camshaft phaser assembly shown in FIG. 1.

FIG. 3 is a front view of camshaft phaser assembly 100 shown in FIG. 1.

Figure 4:
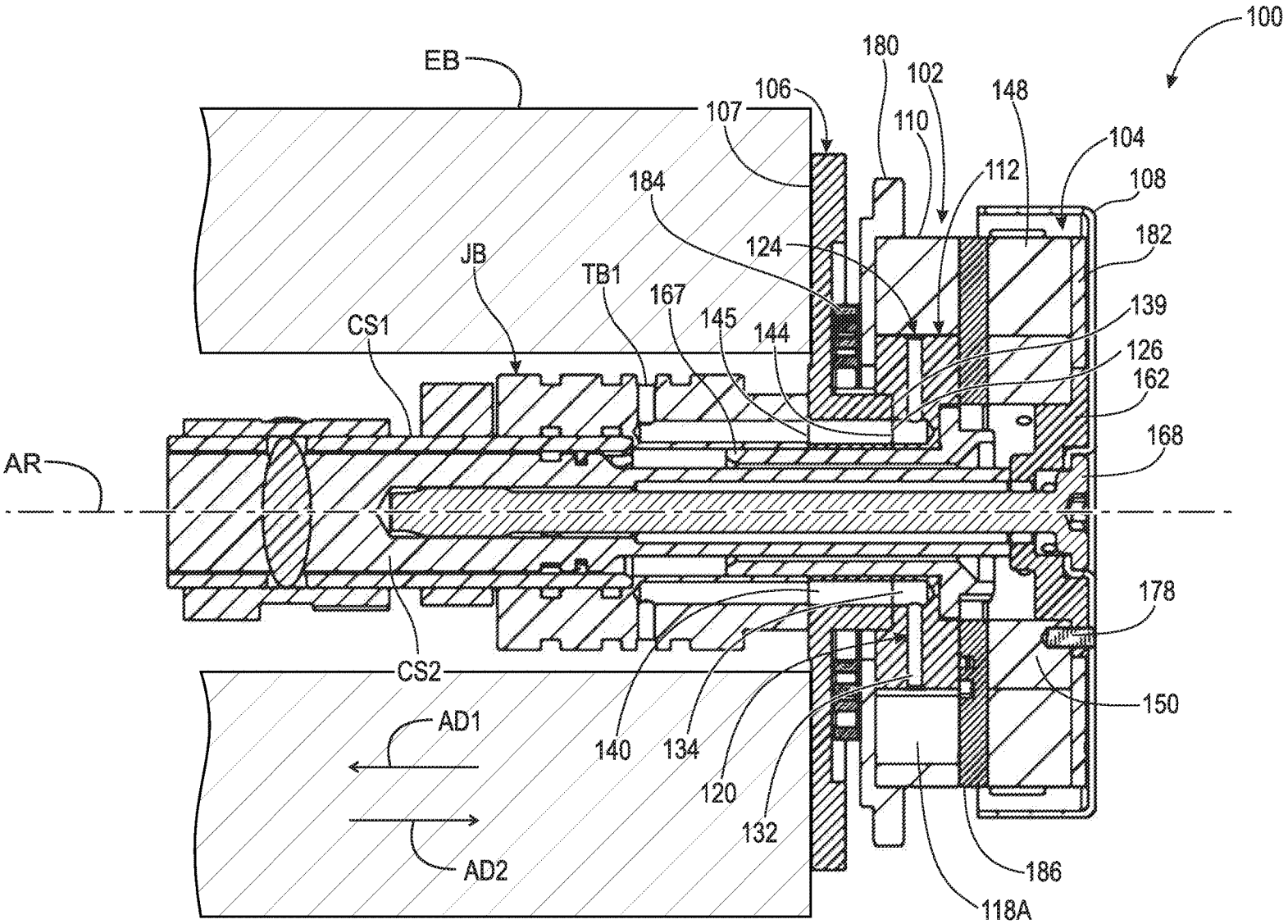
FIG. 4 is a cross-sectional view generally along line 4-4 in FIG. 3.

FIG. 4 is a cross-sectional view generally along line 4-4 in FIG. 3.

Figure 5:
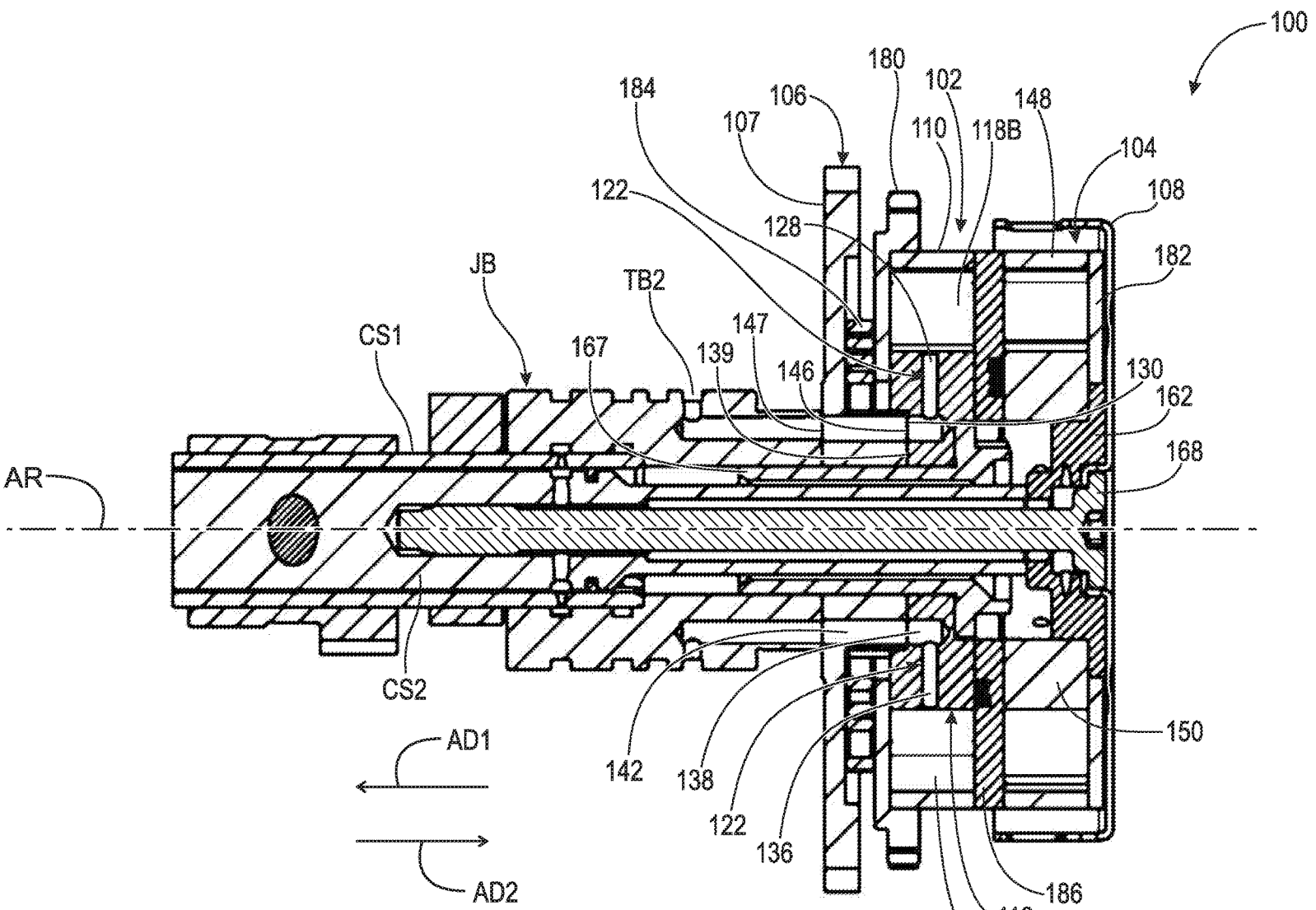
FIG. 5 is a cross-sectional view generally along line 5-5 in FIG. 3.

FIG. 5 is a cross-sectional view generally along line 5-5 in FIG. 3. The following should be viewed in light of FIGS. 1 through 5. Rotor 112 includes through-bores 120 and through-bores 122. Each through-bore 120 includes: end 124 open to a respective phaser chamber 118A; and an opposite end 126. Each through-bore 122 includes end 128 open to a respective phaser chamber 118B; and an opposite end 130.

By "through-bore" in a component, we mean that the through-bore is wholly enclosed by the component and includes a first end open to an exterior of the component and a second end open to the exterior of the component. The through-bore can be a single segment in a straight line, or can be two or more connected segments at angles with respect to each other. For example: through-bores 120 and 122 are wholly enclosed by rotor 112; and each end of the through-bores is open to the exterior surface of rotor 112. Through-bores 120 and 122 each includes two segments. Through-bores 120 include: segments 132 with ends 124; and segments 134 with ends 126. Through-bores 122 include: segments 136 with ends 128; and segments 138 with ends 130.

Trigger wheel 106 includes: surface 139 facing in direction AD2, opposite direction AD1, and in contact with rotor 112; through-bores 140; and through-bores 142. Each through-bore 140 includes: end 144 directly connected to a respective through-bore 120, for example at end 128; and end 145 in surface 107. Each through-bore 142 includes: end 146 directly connected to a respective through-bore 122, for example at end 130; and end 147 in surface 107. Through-bores 140 and 142 alternate in circumferential direction CD1.

Axis AR does not pass through through-bores 120, 122, 140, or 142. In the example of FIG. 1: at least a portion of through-bores 120 are radially inward of through-bores 122; and at least a portion of through-bores 140 are radially inward of through-bores 142.

Figure 6:
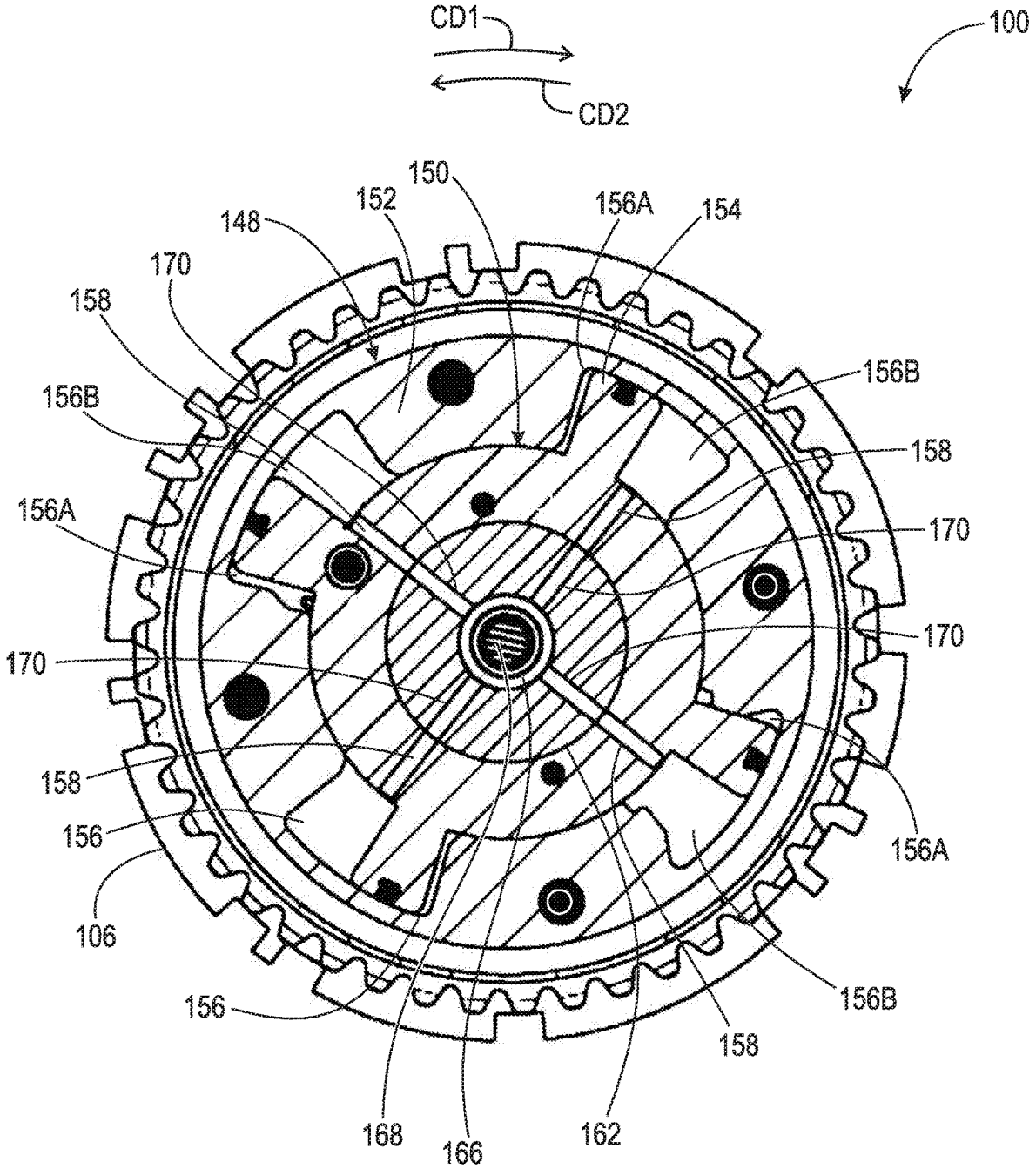
FIG. 6 is a cross-sectional view generally along line 6-6 in FIG. 1.

FIG. 6 is a cross-sectional view generally along line 6-6 in FIG. 1.

Figure 7:
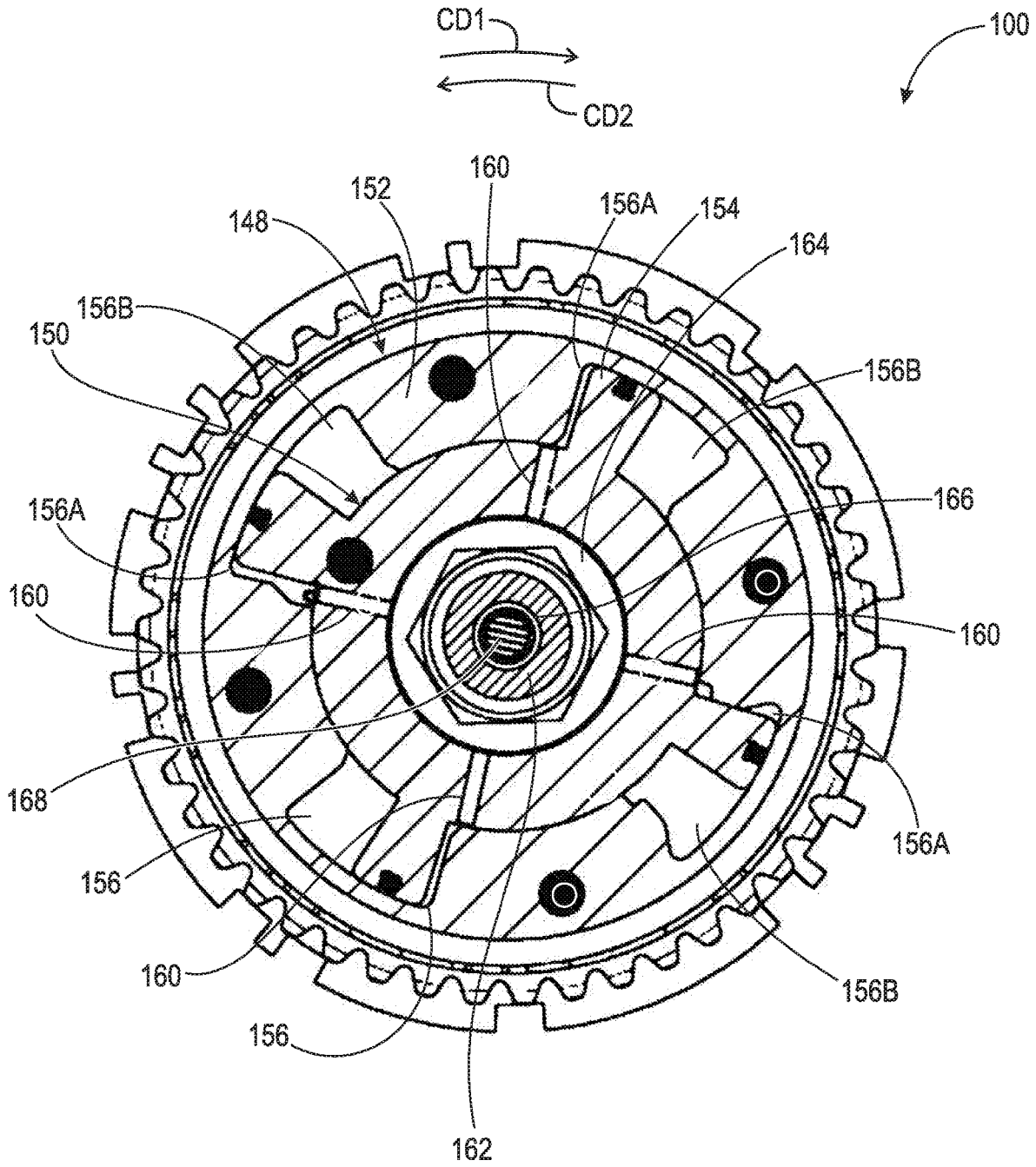
FIG. 7 is a cross-sectional view generally along line 7-7 in FIG. 1.

FIG. 7 is a cross-sectional view generally along line 7-7 in FIG. 1. The following should be viewed in light of FIGS. 1 through 7. In the example of FIG. 1, hydraulic camshaft phaser 104 includes stator 148 and rotor 150. Stator 148 is non-rotatably connected to stator 110 and includes radially inwardly extending protrusions 152. Rotor 150 includes radially outwardly extending protrusions 154 circumferentially interleaved with radially inwardly extending protrusions 152. That is, protrusions 152 and 154 alternate in circumferential direction CD1. Phaser 104 includes phaser chambers 156.

In the example of FIG. 1, phaser chambers 156 include pairs of advance chambers 156A and retard chambers 156B, alternating in direction CD1 and whose function is discussed below. Each phaser chamber 156 is circumferentially bounded by a respective radially inwardly extending protrusion 152 and a respective radially outwardly extending protrusion 154.

Rotor 150 includes through-bores 158 and 160. Each through-bore 158 connects a respective phaser chamber 156B. Each through-bore 160 connects to a respective phaser chamber 156A.

Figure 8:
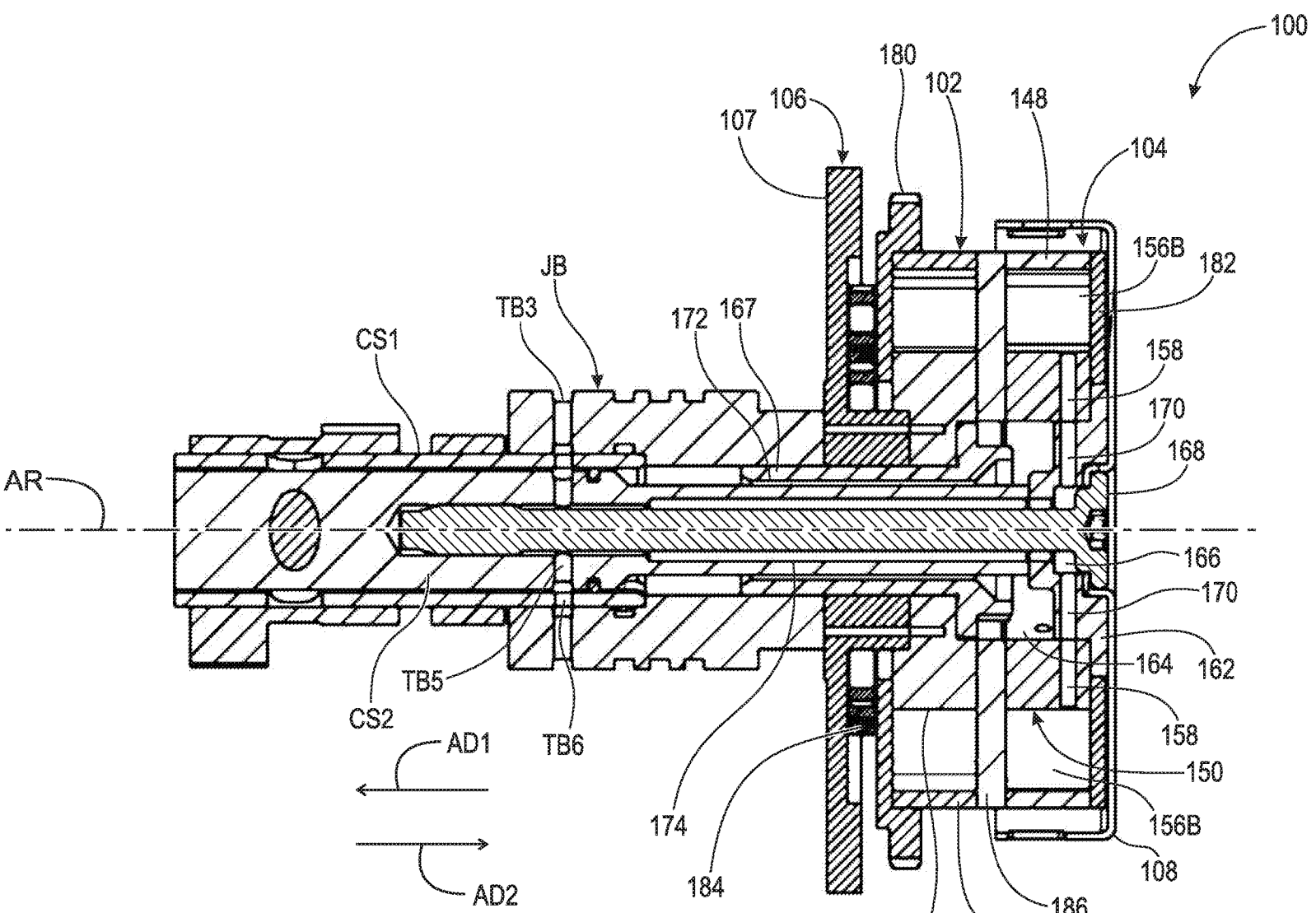
FIG. 8 is a cross-sectional view generally along line 8-8 in FIG. 3.

FIG. 8 is a cross-sectional view generally along line 8-8 in FIG. 3.

Figure 9:
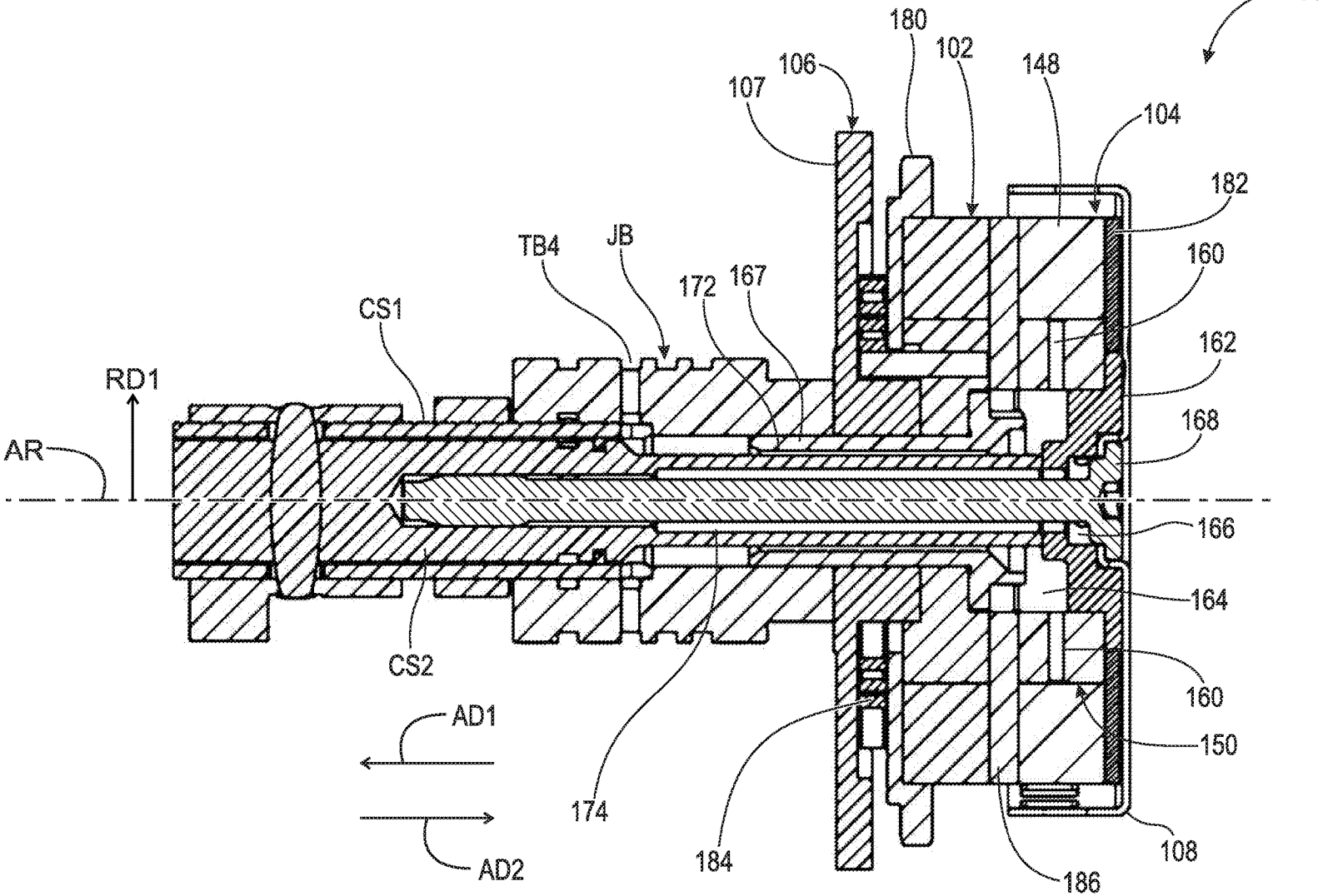
FIG. 9 is a cross-sectional view generally along line 9-9 in FIG. 3.

FIG. 9 is a cross-sectional view generally along line 9-9 in FIG. 3. The following should be viewed in light of FIGS.

1 through 9. In the example of FIG. 1, assembly 100 includes: cap 162; fluid chamber 164; fluid chamber 166; hollow bolt 167; and bolt 168. Bolt 167 is arranged to non-rotatably connect rotor 112 to camshaft CS1. Bolt 168 is arranged to non-rotatably connect rotor 150 to camshaft CS2. Chamber 164 is bounded in part by cap 162 and rotor 150. Chamber 166 is bounded in part by cap 162 and bolt 168. Cap 162 includes through-bores 170 connecting through-bores 158 and chamber 166. Through-bores 160 open to chamber 164.

In the example of FIG. 1, assembly 100 includes channel 172 and channel 174. Channel 172 is bounded by in part bolt 167 and is arranged to be bounded in part by camshaft CS2. Channel 174 is bounded in part by bolt 168 and is arranged to be bounded in part by camshaft CS2. Channel 172 connects to chamber 164 and channel 174 connects to chamber 166.

In an example embodiment, rotor 112 is arranged to non-rotatably connect to journal bearing JB, which in turn is non-rotatably connected to camshaft CS1. Journal bearing JB is used to supply oil or other fluid to assembly 100 to operate phasers 102 and 104 as is known in the art. For example, journal bearing JB includes through-bores TB1 and TB2 arranged to connect to through-bores 120 and 122, respectively. For example, journal bearing JB includes through-bores TB3 and TB4. Through-bores TB3 are arranged to connect to channel 174 via through-bores TB5 and TB6 in camshafts CS2 and CS1, respectively. Through-bores TB4 are arranged to connect to channel 172.

In an example embodiment, assembly 100 includes pin 176 and pin 178. Pin 176 and pin 178 each: pass through trigger wheel 108 and cap 162 and extend into rotor 150. Pin 176 and pin 178 fix trigger wheel 108 to a predetermined circumferential position with respect to rotor 150. As is known in the art, trigger wheel 108 is used to determine a circumferential position of rotor 150 for use in rotating rotor 150, with respect to stator 148, to phase camshaft CS2. Pins 176 and 178 ensure that trigger wheel 108 is in the predetermined position upon which rotation of rotor 150 is predicated.

Figure 10:
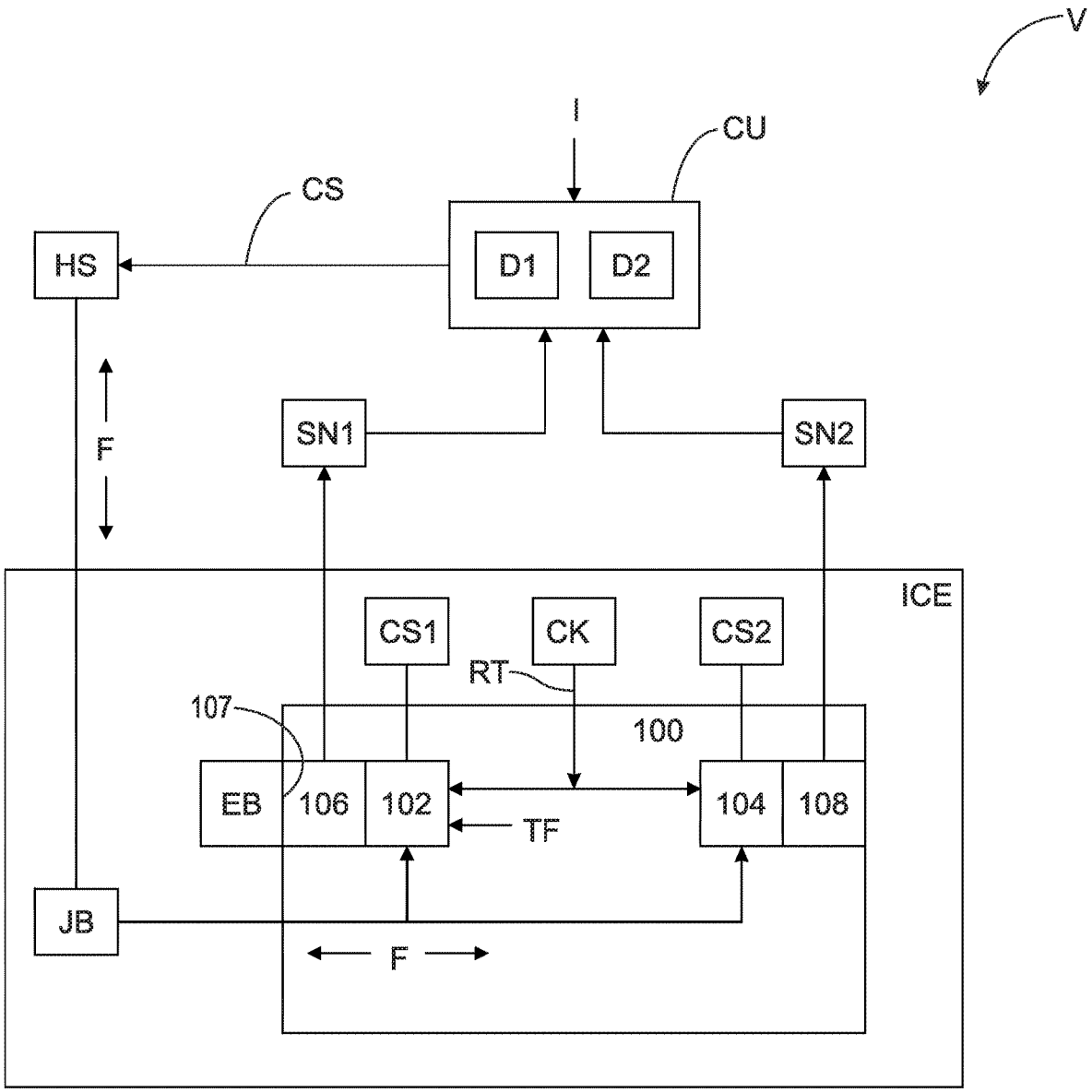
FIG. 10 is a schematic block diagram of the camshaft phaser assembly shown in FIG. 1 in a vehicle.

FIG. 10 is a schematic block diagram of camshaft phaser assembly 100 shown in FIG. 1 in vehicle V. The following should be viewed in light of FIGS. 1 through 10. FIG. 10 illustrates an example implementation of assembly 100 and trigger wheels 106 and 108. Trigger wheel 106 includes axial surface 107. When assembly 100 is installed in vehicle V, surface 107 is arranged to contact engine block EB and act as the thrust surface between assembly 100 and block EB. Circumferential positions of trigger wheels 106 and 108 are read or measured by sensors SN1 and SN2, respectively. Sensors SN1 and SN2 transmit data D1 and D2 regarding the circumferential positions of trigger wheels 106 and 108, respectively, to control unit CU. Control unit CU uses data D1 and D1 and input I from other components as needed to send control signal CS for operation of hydraulic system HS, which controls transmission of fluid F to and from phasers 102 and 104. For example, if input I calls for camshaft CS1 to be advanced or retarded, data Dl is used as feedback to identify the required position of rotor 112, with respect to stator 110, for advancing or retarding camshaft CS1.

In the example of FIG. 1: stator 110 includes input gear 180 arranged to receive the rotational torque; phaser 104 includes sealing cover 182; phaser 102 includes bias spring 184; and assembly 100 includes locking cover 186 non-rotatably connected to stators 110 and 148, and axially disposed between rotors 112 and 150. In an example embodiment (not shown), phaser 104 includes a bias spring.

The following should be viewed in light of FIGS. 1 through 10. The following describes a method of using a camshaft phaser assembly. Although the method is presented as a sequence of steps for clarity, no order should be inferred from the sequence unless explicitly stated. The camshaft phaser assembly includes: hydraulic camshaft phaser 102 with stator 110, rotor 112 and phaser chambers 118 bounded by stator 110 and rotor 112; hydraulic camshaft phaser 104; trigger wheel 106 non-rotatably connected to rotor 110; and trigger wheel 108 connected to hydraulic camshaft phaser 104. A first step non-rotatably connects rotor 112 to camshaft CS1 of internal combustion engine ICE of vehicle V. A second step starts internal combustion engine ICE. A third step transmits rotational torque RT from internal combustion engine ICE to stator 110. A fourth step rotates, with rotational torque RT, stator 110 and rotor 112. A fifth step creates, with the rotation of stator 110 and rotor 112, thrust force TF. A sixth step urges, with thrust force TF, hydraulic camshaft phaser 102 toward engine block EB of internal combustion engine ICE. A seventh step contacts engine block EB with surface 107 of trigger wheel 106. An eighth step identifies, using trigger wheel 106, sensor SN1, and control unit CU, a rotational position of rotor 112. A ninth step flows fluid F to phaser chambers 118 through: through-bores 140, in trigger wheel 106, connected to through-bores 120 in rotor 112; and through-bores 142, in trigger wheel 106, connected through-bores 122 in rotor 112. A tenth step rotates, with fluid F, rotor 112 with respect to stator 110.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

AD1 axial direction
AD2 axial direction
AR axis of rotation
CD1 circumferential direction
CD2 circumferential direction
CS control signal
CS1 camshaft
CS2 camshaft
CU control unit
D1 data
D2 data
EB engine block
HS hydraulic system
ICE internal combustion engine
JB journal bearing
RT rotational torque
SN1 sensor
SN2 sensor
TB1 through-bore
TB2 through-bore
TB3 through-bore
TB4 through-bore
TB5 through-bore
TB6 through-bore
TF thrust force
V vehicle
100 camshaft phaser assembly
102 hydraulic camshaft phaser

104 hydraulic camshaft phaser
106 trigger wheel
107 surface, trigger wheel 106
108 trigger wheel
110 stator, camshaft phaser 102
112 rotor, camshaft phaser 102
114 radially inwardly extending protrusion, stator
116 radially outwardly extending protrusion, rotor
118 phaser chamber, hydraulic camshaft phaser
118A advance phaser chamber
118B retard phaser chamber
120 through-bore, rotor
122 through-bore, rotor
124 end, through-bore 120
126 end, through-bore 120
128 end, through-bore 122
130 end, through-bore 122
132 segment, through-bore 120
134 segment, through-bore 120
136 segment, through-bore 122
138 segment, through-bore 122
139 surface, trigger wheel 106
140 through-bore, trigger wheel 106
142 through-bore, trigger wheel 106
144 end, through-bore 140
145 end, through-bore 140
146 end, through-bore 142
147 end, through-bore 142
148 stator
150 rotor
152 radially inwardly extending protrusion, stator
154 radially outwardly extending protrusion, rotor
156 phaser chamber, camshaft phaser 104
156A advance phaser chamber
156B retard phaser chamber
158 through-bore, rotor
160 through-bore, rotor
162 cap
164 fluid chamber
166 fluid chamber
167 hollow bolt
168 bolt
170 through-bore, cap
172 channel
174 channel
176 pin
178 pin
180 input gear
182 sealing cover
184 bias spring
186 locking cover

The invention claimed is:

1. A camshaft phaser assembly, comprising:
an axis of rotation;
a first hydraulic camshaft phaser including:
a first stator including an input gear arranged to receive rotational torque;
a first rotor including a plurality of first through-bores; and,
a first plurality of phaser chambers circumferentially bounded by the first stator and the first rotor;
a second hydraulic camshaft phaser including:
a second stator non-rotatably connected to the first stator;
a second rotor; and,
a second plurality of phaser chambers circumferentially bounded by the second stator and the second rotor;
a first trigger wheel:
including a plurality of second through-bores connected to the plurality of first through-bores;
non-rotatably connected to the first rotor; and,
arranged to identify a rotational position of the first rotor; and,
a second trigger wheel:
non-rotatably connected to the second rotor; and,
arranged to identify a rotational position of the second rotor.

2. The camshaft phaser assembly of claim 1, wherein the first hydraulic camshaft phaser and the second hydraulic camshaft phaser are axially disposed between the first trigger wheel and the second trigger wheel.

3. The camshaft phaser assembly of claim 1, wherein:
each first through-bore includes:
a first end open to a respective phaser chamber included in the first plurality of phaser chambers; and,
a second end; and,
each second through-bore is directly connected to a respective second end.

4. The camshaft phaser assembly of claim 1, wherein:
the first rotor includes a plurality of third through-bores; and,
the first trigger wheel includes a plurality of fourth through-bores connected to the plurality of third through-bores.

5. The camshaft phaser assembly of claim 4, wherein:
the plurality of first through-bores opens to a plurality of first phaser chambers included in the first plurality of phaser chambers;
the plurality of third through-bores:
opens to a plurality of second phaser chambers included in the first plurality of phaser chambers; and,
includes a plurality of second ends;
the plurality of second phaser chamber is circumferentially interleaved with the plurality of first phaser chambers; and,
the plurality of fourth through-bores directly connects to the plurality of second ends.

6. The camshaft phaser assembly of claim 1, wherein:
the first rotor includes a plurality of third through-bores;
at least a portion of the plurality of third through-bores is radially inward of the plurality of first through-bores,
the first trigger wheel includes a plurality of fourth through-bores connected to the plurality of third through-bores; and,
at least a portion of the plurality of fourth through-bores is radially inward of the plurality of second through-bores.

7. The camshaft phaser assembly of claim 6, wherein the second through-bores and the fourth through-bores alternate in a circumferential direction.

8. The camshaft phaser assembly of claim 1, wherein:
the plurality of first through-bores is connected to a plurality of first phaser chambers included in the first plurality of phaser chambers;
the first rotor includes a plurality of third through-bores;
the plurality of third through-bores is connected to a plurality of second phaser chambers included in the first plurality of phaser chambers;
the plurality of first phaser chambers are circumferentially interleaved with the plurality of second phaser chambers;

the first trigger wheel includes a plurality of fourth through-bores connected to the plurality of third through-bores; and, the plurality of second through-bores and the plurality of fourth through-bores alternate in a circumferential direction.

9. The camshaft phaser assembly of claim 1, wherein:

the first trigger wheel includes:

a first surface facing in a first axial direction and forming an axial end of the first trigger wheel; and, a second surface in contact with the first rotor and facing in a second axial direction, opposite the first axial direction; and, each second through-bore includes an end in the first surface.

10. The camshaft phaser assembly of claim 9, wherein:

the first rotor includes a plurality of third through-bores;

the first trigger wheel includes a plurality of fourth through-bores connected to the plurality of third through-bores;

the plurality of fourth through-bores is radially inward of the plurality of second through-bores; and, each fourth through-bore includes an end in the first surface.

11. The camshaft phaser assembly of claim 1, wherein:

the first trigger wheel includes a surface facing in a first axial direction; and, when the camshaft phaser assembly is installed in a vehicle, the surface is arranged to contact an engine block of the vehicle.

12. The camshaft phaser assembly of claim 1, wherein:

a circumferential position of the first trigger wheel is arranged to be identified by a first sensor and a control unit; and, a circumferential position of the second trigger wheel is arranged to be identified by a second sensor and the control unit.

13. The camshaft phaser assembly of claim 1, further comprising:

a hollow bolt:

passing through the first trigger wheel; and, arranged to non-rotatably connect the first rotor to a first camshaft.

14. The camshaft phaser assembly of claim 13, further comprising:

a bolt:

passing through the hollow bolt; and, arranged to non-rotatably connect the second rotor to a second camshaft.

15. The camshaft phaser assembly of claim 1, wherein:

the first stator includes a first plurality of radially inwardly extending protrusions;

the first rotor includes a first plurality of radially outwardly extending protrusions circumferentially interleaved with the first plurality of radially inwardly extending protrusions;

the first plurality of phaser chambers is circumferentially bounded by the first plurality of radially inwardly extending protrusions and the first plurality of radially outwardly extending protrusions;

the second stator includes a second plurality of radially inwardly extending protrusions;

the second rotor includes a second plurality of radially outwardly extending protrusions circumferentially interleaved with the second plurality of radially inwardly extending protrusions; and, the second plurality of phaser chambers is circumferentially bounded by the second plurality of radially inwardly extending protrusions and the second plurality of radially outwardly extending protrusions.

16. A camshaft phaser assembly, comprising:

an axis of rotation;

a first hydraulic camshaft phaser including:

a first stator arranged to receive rotational torque;

a first rotor; and, a first plurality of phaser chambers circumferentially bounded by the first stator and the first rotor;

a plurality of first through-bores in the first rotor connected to a plurality of first phaser chambers included in the first plurality of phaser chambers; and, a plurality of second through-bores in the first rotor:

connected to a plurality of second phaser chambers, the plurality of second phaser chambers included in the first plurality of phaser chambers and circumferentially interleaved with the plurality of first phaser chambers;

a second hydraulic camshaft phaser including:

a second stator non-rotatably connected to the first stator;

a second rotor; and, a second plurality of phaser chambers circumferentially bounded by the second stator and the second rotor;

a first trigger wheel:

non-rotatably connected to the first rotor;

arranged to identify a rotational position of the first rotor; and, including:

a plurality of third through-bores connected to the plurality of first through-bores; and, a plurality of fourth through-bores connected to the plurality of second through-bores; and, a second trigger wheel:

non-rotatably connected to the second rotor; and, arranged to identify a rotational position of the second rotor, wherein at least a portion of the plurality of fourth through-bores is radially inward of the plurality of third through-bores.

17. The camshaft phaser assembly of claim 16, wherein the third through-bores alternate, in a circumferential direction, with the fourth through-bores.

18. The camshaft phaser assembly of claim 16, wherein:

the first trigger wheel includes a surface facing in an axial direction; and, when the camshaft phaser assembly is installed in a vehicle, the surface is arranged to contact an engine block of the vehicle.

19. A method of using a camshaft phaser assembly, the camshaft phaser assembly including: a first hydraulic camshaft phaser with a stator, a rotor and a plurality of phaser chambers bounded by the stator and the rotor; a second hydraulic camshaft phaser; a first trigger wheel non-rotatably connected to the rotor; and a second trigger wheel connected to the second hydraulic camshaft phaser, the method comprising:

non-rotatably connecting the rotor to a first camshaft of an internal combustion engine of a vehicle;

starting the internal combustion engine;

transmitting rotational torque from the internal combustion engine to the stator;

rotating, with the rotational torque, the stator and the rotor;

creating, with the rotation of the stator and the rotor, a thrust force;

urging, with the thrust force, the first hydraulic camshaft phaser toward an engine block of the internal combustion engine;

contacting the engine block with a surface of the first trigger wheel;

identifying, using the first trigger wheel, a rotational position of the rotor;

flowing oil to the plurality of phaser chambers:

through a first plurality of through-bores in the first trigger wheel connected to a second plurality of through-bores in the rotor; and, through a third plurality of through-bores in the first trigger wheel connected to a fourth plurality of through-bores in the rotor; and, rotating the rotor with respect to the stator.

* * * * *